US009731872B2

(12) United States Patent
Beine

(10) Patent No.: US 9,731,872 B2
(45) Date of Patent: Aug. 15, 2017

(54) CLOSURE CAP

(71) Applicant: B. BRAUN MELSUNGERN AG, Melsungen (DE)

(72) Inventor: Joachim Beine, Guxhagen (DE)

(73) Assignee: B. Braun Melsungern AG, Melsungen (DE)

( * ) Notice: Subject to any disclaimer, the term of this patent is extended or adjusted under 35 U.S.C. 154(b) by 0 days.

(21) Appl. No.: 14/394,671

(22) PCT Filed: May 8, 2013

(86) PCT No.: PCT/EP2013/059621

§ 371 (c)(1),
(2) Date: Oct. 15, 2014

(87) PCT Pub. No.: WO2013/167672

PCT Pub. Date: Nov. 14, 2013

(65) Prior Publication Data

US 2015/0069008 A1 Mar. 12, 2015

(30) Foreign Application Priority Data

May 9, 2012 (EP) ..... 12167271

(51) Int. Cl.

| | |
|---|---|
| ***A61J 1/00*** | (2006.01) |
| ***B65D 41/28*** | (2006.01) |
| ***A61J 1/14*** | (2006.01) |
| ***B65D 51/00*** | (2006.01) |
| ***B65D 39/04*** | (2006.01) |

(52) U.S. Cl.

CPC ..... *B65D 41/28* (2013.01); *A61J 1/1406* (2013.01); *A61J 1/1487* (2015.05); *B65D 39/04* (2013.01); *B65D 51/002* (2013.01); *A61J 1/1431* (2015.05); *F04C 2270/0421* (2013.01)

(58) Field of Classification Search

CPC ..... B65D 41/28; B65D 39/04; B65D 51/002; A61J 1/1475; A61J 1/1406; A61J 1/1431; A61J 1/1487; F04C 2270/0421

USPC ..... 215/354, 249, 247; 604/415

See application file for complete search history.

(56) References Cited

U.S. PATENT DOCUMENTS 1,871,907 A * 8/1932 Olt ..... B65D 39/04 220/789
2,649,090 A * 8/1953 Parsons ..... B65D 39/00 215/355
3,059,798 A * 10/1962 Darmstadt et al. ..... 215/12.1
(Continued)

FOREIGN PATENT DOCUMENTS

CN 1356950 A 7/2002
DE 25 04 253 A1 8/1975
(Continued)

OTHER PUBLICATIONS

Jul. 11, 2013 International Search Report issued in International Application No. PCT/EP2013/059621.

*Primary Examiner* — James N Smalley
(74) *Attorney, Agent, or Firm* — Seth L. Hudson; Clements Bernard Walker PLLC

(57) ABSTRACT

A closure cap (1) having a flange (2) for connecting to a flange of an infusion solution container, wherein the cap (1) has at least one integrated stopper (3*a*, 3*b*) in order for liquids to be removed from, or introduced into, the container and for re-sealing purposes once liquid has been removed or introduced.

9 Claims, 2 Drawing Sheets

(56) References Cited

U.S. PATENT DOCUMENTS

| | | | | | |
|---|---|---|---|---|---|
| 3,164,279 | A * | 1/1965 | Towns | B01L 3/50825 | 215/227 |
| 3,904,059 | A * | 9/1975 | Bellamy et al. | 215/247 | |
| 3,905,368 | A | 9/1975 | Lewis, Jr. et al. | | |
| 4,501,372 | A * | 2/1985 | Hansen | B65D 51/002 | 215/247 |
| 5,320,237 | A * | 6/1994 | Stolzman | B65D 39/084 | 215/251 |
| 5,385,253 | A * | 1/1995 | Scharf | B65D 39/04 | 215/296 |
| 5,678,713 | A * | 10/1997 | Derksen | B65D 51/002 | 215/249 |
| 5,833,088 | A | 11/1998 | Kladders et al. | | |
| 7,213,593 | B2 * | 5/2007 | Hochrainer | 128/200.14 | |
| 8,091,727 | B2 * | 1/2012 | Domkowski | 220/320 | |
| 2001/0039058 | A1 | 11/2001 | Iheme et al. | | |
| 2004/0112855 | A1 * | 6/2004 | Becker | B29C 45/16 | 215/247 |
| 2004/0131506 | A1 * | 7/2004 | Zurcher | B01L 3/50825 | 422/400 |
| 2009/0054865 | A1 * | 2/2009 | Brandenburger | B65D 51/002 | 604/415 |
| 2010/0012615 | A1 * | 1/2010 | Brooks | B65D 41/28 | 215/256 |
| 2011/0245796 | A1 * | 10/2011 | Brandenburger | A61J 1/1406 | 604/414 |
| 2015/0352012 | A1 * | 12/2015 | Pittet | A61J 1/1406 | 604/415 |

FOREIGN PATENT DOCUMENTS

| | | |
|---|---|---|
| DE | 37 44 174 A1 | 7/1989 |
| DE | 103 40 538 A1 | 4/2005 |
| DE | 10 2008 060 457 A1 | 6/2010 |
| EP | 1 211 184 A1 | 6/2002 |

* cited by examiner

CLOSURE CAP

1) FIELD OF THE INVENTION

The invention relates to a closure cap having a flange for connecting to a flange of an infusion solution container, wherein the cap has at least one integrated stopper in order for liquids to be removed from, or introduced into, the container and for re-sealing purposes once liquid has been removed or introduced.

2) BACKGROUND OF THE INVENTION

DE 37 44 174 A1 describes a freeze-drying stopper made of a rubber elastic material and composed of a shank and, connected therewith, a circular disc shaped flange which is made in one piece with the shank. The shank includes a cavity which surrounds the longitudinal axis of the shank, is open toward the free end face of the shank and extends up to a centrally closed wall portion of the flange. A first section of the shank which extends between a first transverse plane defined by the boundary face of the flange and a second transverse plane has a closed outer circumferential face with a maximum diameter. A subsequent second section includes a passage communicating with the cavity, and a plurality of blocking elements. The inner wall face laterally delimiting the cavity, which has an increasing diameter with increasing approach to the free shank end face, is disposed entirely outside of a cone whose axis is the longitudinal axis of the shank, whose tip lies, in the first transverse plane and whose tip angle, in degrees, is larger than a value calculated according to a specific formula. This is supposed to yield a particularly useful stopper that does not hinder the piercing of the withdrawal cannula. In the introductory part of the description, it is stated that prior art stoppers are disadvantageous in that a considerable residual volume of solution or suspension that cannot be withdrawn by means of the cannula remains in the container. Thus, the core of the technical teaching of this patent application is the formation of as small as possible a cavity, wherein the stopper with its closed outer circumferential face is tightly pressed into the mouth of the bottle.

DE 10 2008 060 457 A1 describes a preparation method for a closure. In a method for preparing a closure (1) for a sterile medicament container, it is provided that an elastic sealing element (3) is introduced into a non-elastic closure body (2) that has at least one tunnel opening (11), said sealing element sealingly closes said at least one tunnel opening (11). Said sealing element (3) is firmly bonded to said closure body (2) by partially melting mutually matching regions (12, 13) on said sealing element (3) and said closure body (2) before being inserted, wherein said partially melted regions (12, 13) are brought in contact with each other, cooling down and connecting with each other, when the sealing element (3) is introduced.

DE-PS 25 04 253 describes a container for storing and dispensing sterile solutions. In particular, said container includes an inlet device that can be sealingly closed, comprising a flange formed integrally with the neck wall and extending laterally outward from the end of a neck and completely enclosing the opening of the neck, wherein further at least one passage is provided in a space enclosed by one lateral wall of the inlet device, and a laterally extending flange surrounding the lateral wall at one end thereof conceals the flange provided at the neck, being closely bonded thereto.

EP 1 211 184 A1 describes a closure cap with a disk-shaped flange suitable for connecting to a disk-shaped flange of an infusion solution container, wherein the cap has at least one integrated stopper suitable for withdrawing and supplying a liquid from, or to, the container and for re-sealing purposes once liquid has been removed or introduced. The body, which is directed towards the mouth of the bottle, has a displacer, wherein the liquid of the infusion solution container is in direct contact with the stoppers 1. The cap is connected with the infusion solution container by clip connection. Thus, the withdrawal or introduction of the liquid from or into the container is effected within a range outside the displacer. FIG. 2 describes, without reference signs, an annular seal in a groove of the lateral surface of the displacer, which presently serves a sealing function. Thus, the body cannot immerse into the bottle mouth of the infusion solution container without effort.

DE 103 40 538 A1 describes a sample container for receiving liquids for medical analyses. A closure stopper 3, which extends into the open end of the tube with a cylindrical sealing section, where it seals the tube towards the interior wall 13, is inserted with an exactly fitting shape to seal the tube 2, so that the cylindrical sealing section 9 has no undersize with respect to the bottle mouth, but rather has an oversize with respect to the bottle mouth, so that the stopper cannot go into the opening without application of force.

The problem with the closure caps described in the prior art is the permanent connection thereof with the bottle mouth of the infusion solution container. It is common in the prior art to press the stopper into the bottle mouth, as is usual, for example, when inserting champagne corks. The flange of the champagne cork limits the depth of insertion of the cork into the bottle. However, in this case, it is not possible to withdraw or introduce liquid from, or into, the container, or to reseal the container after liquid has been withdrawn from or supplied to it, without completely removing the cork.

It is a further object of the present invention to reduce the dead volume near the bottle mouth of an infusion solution container.

SUMMARY OF THE INVENTION

The present object is achieved by a closure cap 1 with a disk-shaped flange 2, which is suitable for connection with a disk-shaped flange of an infusion solution container, wherein the cap 1 has at least one integrated stopper 3*a*, 3*b* for withdrawing or supplying liquid from, or into, the container and for resealing after the withdrawal or supply of liquid, which is characterized in that the cap 1 has a body 4 in the form of a displacer directed inwardly in the direction of the bottle mouth of the infusion solution container, which reduces the dead volume of the container and is capable of being inserted into the bottle mouth without application of force because of an undersize with respect to the bottle mouth.

DETAILED DESCRIPTION OF THE INVENTION

Figure 1:
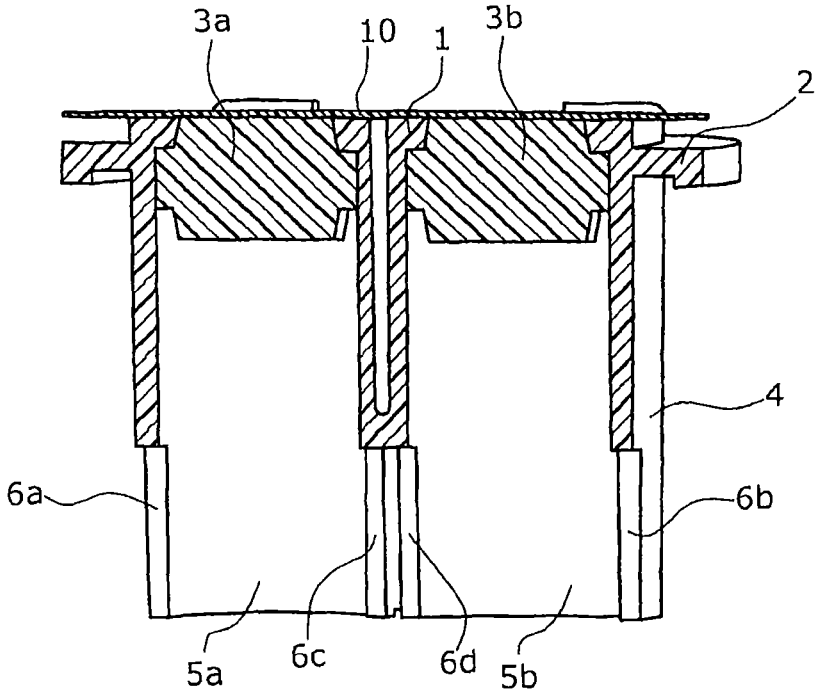
FIG. 1 is a cross-section side view of the closure cap of the invention.

In particular, the present invention relates to a closure cap 1 for withdrawing solutions, especially outside rigid container systems. The cap 1 is put on the edge or flange provided at the container, where it is firmly bonded or connected in a friction-type manner with the infusion solution container. The construction of the cap 1 according to the invention is adapted, in particular, to open containers that are generally produced by an extrusion blowing method (EBM) or injection stretch blow molding (ISBM). Preferably, the geometry of the flanges corresponds to the degree of ovality of the flange body and accordingly can have a circular or elliptical design.

The overall system constructively consists of the actual cap 1 with the connecting flange 2, the inserted stoppers 3*a*, 3*b* for injecting or withdrawing solutions with reseal, their channels 5*a*, 5*b* designed as receiving areas for infusion solution, and, in particular, a tamper-proof sealing sheet 10. In principle, the latter can be sealed onto the cap 1 with its whole area, or only partially near the stoppers 3*a*, 3*b*, depending on the particular design.

In order to provide cap 1 according to the invention with displacer properties for the bottle-neck volume, a separation membrane is applied by injection-molding preferably radially on the inside. Depending on the design, it can be integral with the cap 1, or consist of two parts that are, for example, firmly bonded with one another in a separate bonding process.

In principle, the connection of the stoppers 3*a*, 3*b* with the cap 1 can be effected by bonding, for example, laser welding, crimping of the receiving cups or clamps and holding a separate part against them. The sealing application of the sealing cover sheet 10 is effected, as the name suggests, by a sealing process, which is the suitable technology for sheets of this kind. Thus, it corresponds to commercially available caps 1 as judged by the kind of components employed.

The commercially available container systems for infusion solutions contain a more or less large amount of air above the solution level. This enables a uniform flow or withdrawal rate depending on the flexibility of the container, and also regulates the residual volume remaining in the container after infusion. In addition to the mentioned volume of air in the container, the so-called headspace, the insertion depth of the infusion spike or the volume around the spike that is not available to the spike opening is also responsible. This is where the core of the present invention applies.

While the usual commercially available cap systems for semi-rigid infusion solution containers have an outwardly placed withdrawal region, whose design is tailored to the dimensions of the head membrane of the BFS containers, the stopper 3*a*, 3*b*, or the septum, is moved inwards into the bottle mouth according to the invention. The open mouth region, especially of ISBM-produced containers, allows for such a design. The cap 1 pointing into the mouth region of the bottle fills the bottle neck volume almost completely, and drastically reduces the residual volume in the container after the withdrawal. Because the cap 1 present in the mouth region bridges the liquid volume not covered by the spike, the residual volume can be drastically reduced to values of, for example, below 2 ml.

These low dead volumes are enabled, in particular, by communicating channels 5*a*, 5*b* between the two injection openings and further channels that extend towards the circumference of the body of the closure cap 1. Thus, the channels 5*a*, 5*b* become communicating vessels, and thereby enable the injection site that is not used to run empty too in a case where more than one stopper is provided.

The closure cap 1 according to the invention is provided with a circular disk-shaped flange 2, for connection with a flange of an infusion solution container. The connection between the two flanges 2 can be effected either through application of external heat, for example, infrared welding, or through internal heat generation by ultrasound, vertically or in an oscillating manner. Also, adhesive bonding, press-bonding or clipping is also possible in addition to welding. Injection-molding around the components is also a possibility for connecting the closure cap 1 according to the invention with the infusion solution container.

As to the dimensional design of the cap 1 or displacer 4, it is important according to the present invention that it has undersize or is conical, but not sealingly towards the bottle neck. While a press fit is produced in the prior art, a gap remains between the displacer 4 and the bottle neck according to the invention, which gap is filled with liquid during use and also forms a capillary gap that may be colored, depending on the coloring of the liquid. Undersize within the meaning of the present invention means that the displacer 4 can slide in the bottle neck without an application of force in a way similar to that of a piston in a cylinder of an internal combustion engine.

Ridges 8 attached to the displacer 4 near and along the cylindrical lateral surface selectively allow the access of liquid in this area. This property of the non-sealing design, which at first appears disadvantageous, renders the validation of the sterilization process significantly simpler, because the annular gap allows the access of the container liquid to all areas of the bottle neck and thus also allows a sterilization of the bottle mouth as an indicator of a completed autoclavation.

As usual in the prior art, the stoppers 3*a*, 3*b* can also be designed as a septum, which is bonded with the cap 1 in a microbiologically sealing way by per se known methods. In addition to the ridges 8 of the displacer 4, the closure cap 1 according to the invention may also have other ridges 9 in the area of the disk-shaped flange 2. These extend over a planar annular boundary surface of flange 2 through a length that enables a positive-locking, firmly bonding or friction-type connection of this flange 2 with a flange of the infusion solution container. Accordingly, the seating of the flange 2, which is preferably annular in shape, has a larger radius than the boundary surface surrounded by grooves 7*a*, 7*b*, 7*c*, 7*d*, which is also annular in shape.

Because of the stoppers 3*a*, 3*b* present in the area of the cap 1, a further injection volume can be added with a usual hypodermic needle for the injection range in addition to the container solution. The withdrawal port can be pierced with a commercially available spike to administer the solution, as in the prior art. Depending on the application and design, the withdrawal of the solution can also be effected through a needle-free access, which eliminates the use of a needle.

FIG. 1 shows a closure cap 1 according to the invention with an annular-shaped flange 2, which serves for connection with a flange of an infusion solution container (not shown), which is also annular in shape. The cap 1 comprises two integrated stoppers 3*a*, 3*b* for withdrawing and supplying liquid from, or into, the container, and for resealing after the withdrawal or introduction of liquid. However, according to the invention, it is not necessarily required that two stoppers 3*a*, 3*b* are integrated in the cap 1. Thus, in an essential embodiment of the present invention, only one stopper 3*a* is integrated in the cap 1 according to the invention. The stoppers 3*a*, 3*b* are preferably prepared from an elastic material, especially from a thermoplastic material, and connected with the body in a microbiologically sealing way by a per se known method.

The cap 1 according to the invention further has a displacer 4 directed inwardly in the direction of the bottle mouth, which is designed in the form of a displacer 4. By means of this displacer 4, the overall dead volume of the container is reduced. In contrast to the prior art, the displacer 4 preferably has an undersize with respect to the bottle mouth (not shown), so that said displacer 4 can be inserted into the bottle mouth without application of force.

FIG. 1 further shows the sealing sheet 10, which covers the two stoppers 3*a*, 3*b* in this case. Further, the channels 5*a*, 5*b* with the communicating passages/notches 6*a*, 6*b*, 6*c*, 6*d* can be seen. These enable the exchange of liquid between the channels 5*a*, 5*b*, especially when these extend over only part of the length of the body 4.

Figure 2:
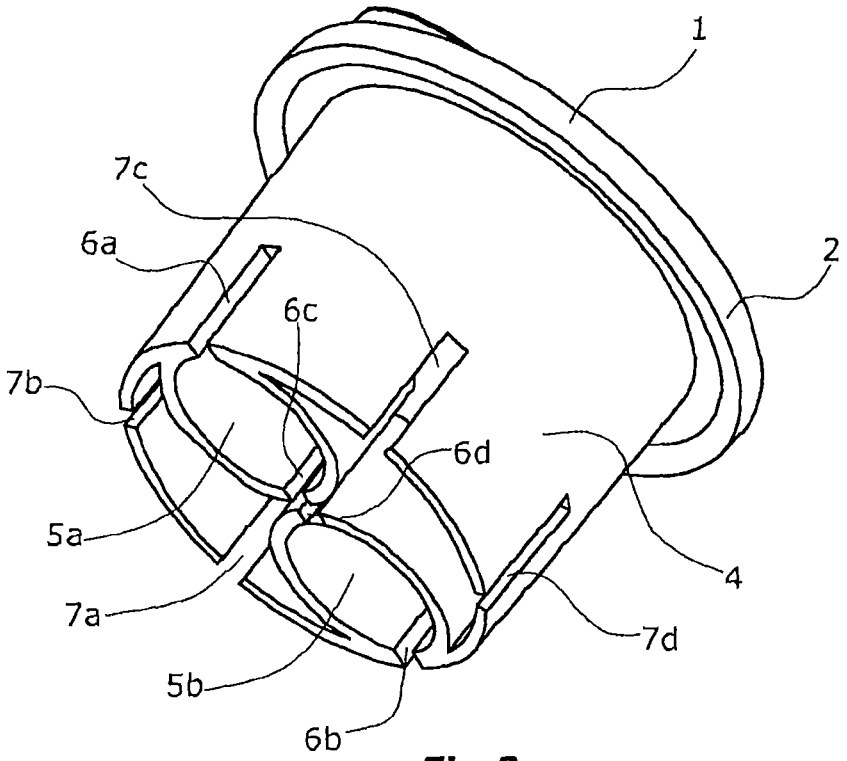
FIG. 2 is an oblique perspective view of the closure cap of the invention.

The passages/notches 6*a*, 6*b*, 6*c*, 6*d* of the channels are highlighted clearly again in FIG. 2. Thus, the communicating channels 5*a*, 5*b* allow the residual volume to be drained from the injection area into the withdrawal area to be withdrawn there. In addition, grooves 7*a*, 7*b*, 7*c*, 7*d* are also present in the outer circumference of the displacer 4, allowing the liquid to flow throughout the areas of the bottle mouth. In addition, the passages/notches 6*a*, 6*b*, 6*c*, 6*d*, and grooves 7*a*, 7*b*, 7*c*, 7*d* allow the stopper 1 to be inserted into the bottle neck, especially if the body 4 is not prepared in undersize with respect to the bottle neck.

Figure 3:
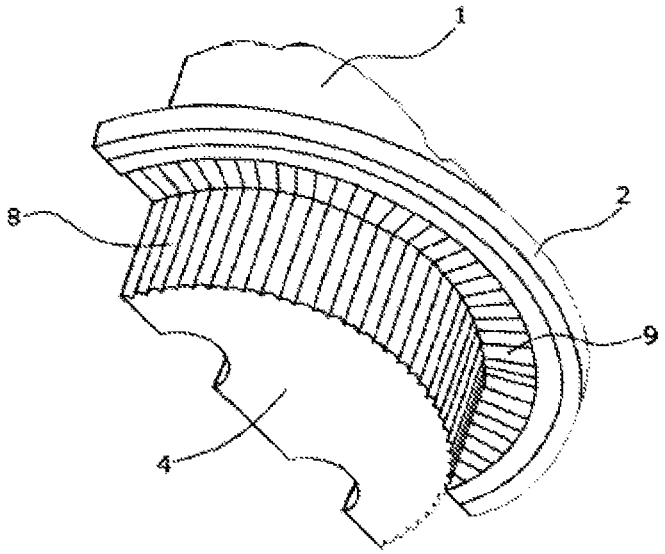
FIG. 3 is a cut away partial enlarged view of the closure cap of the invention.

FIG. 3 shows that the radial surface of the displacer 4 of the closure cap 1 has ridges 8, 9 near the bottle mouth, which extend from the flange 2 towards the infusion solution container. The ridges 8 allow the liquid to flow throughout this area between the cap 1 and the mouth of the infusion solution container, which is of extraordinary importance to a later sterilization. This ensuring of the sterilization of this area as well can be promoted, among other things, by the fact that a planar annular boundary surface of the flange 2 also has planar ridges 9, which enable the liquid to flow throughout the counter-flange of the infusion solution container neck in this area too. In this way, it can be ensured that all areas coming in contact with the liquid can be sterilized even after connection of the cap 1 with the infusion solution container.

The present invention further comprises a corresponding infusion solution container with the cap 1 as defined above, wherein these are welded, adhesive-bonded, press-bonded or clipped together.

The invention claimed is:

1. A closure cap for the mouth of an infusion solution container having dead volume space, said cap closure having a disk-shaped flange which is suitable for connection with a disk-shaped flange of the infusion solution container, wherein said cap has two integrated stoppers for withdrawing or supplying liquid from, or into, the container and for resealing after the withdrawal or supply of liquid, wherein the cap has a displacer directed inwardly in the direction of the mouth of the infusion solution container, which reduces the dead volume space of the container and is capable of being inserted into the bottle mouth because of an undersize with respect to the container mouth, wherein the displacer has an exterior surface with ridges near the container mouth, said ridges extending perpendicularly from the exterior surface of the displacer onto the flange to form L-shaped ridges, said two integrated stoppers are individually and independently accessible, and the displacer has communicating channels interiorly thereof, said stoppers are respectively allocated to said communicating channels in the displacer in order to remove residual infusion solution, and said channels have one or more passages/notches in the length of the displacer, wherein the passages/notches enable the exchange of liquid between the channels.

2. The closure cap according to claim 1, wherein said displacer has a one-piece design and said flange extends outwardly from said displacer.

3. The closure cap according to claim 1, wherein said displacer has grooves, wherein the grooves enable the exchange of liquid between the channels to allow the liquid to flow throughout the areas of the container mouth.

4. The closure cap according to claim 1, wherein the stoppers are made of a thermoplastic elastomer.

5. The closure cap according to claim 1, wherein the stoppers are designed as septa that are connected with the cap in a microbiologically sealing way.

6. The closure cap according to claim 1, characterized by having at least one removable sealing sheet, which covers the stoppers.

7. The closure cap according to claim 1, characterized by being connected by a positive-locking, firmly bonding or friction-type connection with said infusion solution container in the area of the flange.

8. The closure cap according to claim 7, characterized by being welded, adhesive-bonded, press-bonded or clipped to said infusion solution container.

9. An infusion solution container, comprising a closure cap according to claim 1 that is welded, adhesive-bonded, press-bonded or clipped to said container.

* * * * *